United States Patent [19]

Garrett

[11] 4,069,423

[45] Jan. 17, 1978

[54] RADIATION SOURCE SHIELDING AND COLLIMATING DEVICE

[75] Inventor: Roger E. Garrett, Davis, Calif.

[73] Assignee: The Regents of the University of California, Berkeley, Calif.

[21] Appl. No.: 727,682

[22] Filed: Sept. 29, 1976

[51] Int. Cl.[2] ..... G21G 4/00

[52] U.S. Cl. ..... 250/493; 250/497

[58] Field of Search ..... 250/493, 497

[56] References Cited

U.S. PATENT DOCUMENTS

| | | | |
|---|---|---|---|
| 2,891,168 | 6/1959 | Goertz et al. | 250/497 |
| 3,123,713 | 3/1964 | Maud et al. | 250/497 |
| 3,127,515 | 3/1964 | Bernas | 250/497 |

*Primary Examiner*—Harold A. Dixon
*Attorney, Agent, or Firm*—Lothrop & West

[57] ABSTRACT

Especially for use in agricultural machines such as lettuce harvesters having a maturity tester thereon, there is provided a radiation source such as Americium 241 sealed in a capsule at atmospheric pressure. The capsule is disposed in a plunger movable in an evacuated chamber between a first position in alignment with a passage having a window permeable by radiation to the outside and a second position in which the capsule is out of alignment with the passage. A pressure responsive switch monitors the pressure in the chamber and affords an alarm if the chamber pressure rises.

7 Claims, 11 Drawing Figures

RADIATION SOURCE SHIELDING AND COLLIMATING DEVICE

BRIEF SUMMARY OF THE INVENTION

A source of radiation such as Americium 241 is situated in a capsule at atmospheric pressure and is supported on a plunger movable within an evacuated chamber between a first position in alignment with a passage closed by a radiation permeable window to the outside and a second position in which the radiation source is out of alignment with the window. Since the chamber is evacuated, there is afforded a pressure responsive monitoring device providing an alarm in the event the chamber pressure rises.

DETAILED DESCRIPTION

It has in recent years become an acceptable technique to monitor the maturity of growing produce in the field either to determine in advance its maturity or condition for harvesting. Sometimes, the monitor is made a portion of a harvesting mechanism to select individual units of a commodity or of produce for immediate harvesting while leaving other immature or unsuitable produce in the field. Such monitoring or detecting devices are highly satisfactory but employ radioactive sources such as Americium 241 or the like, which must be maintained in an entirely safe and innocuous condition at all times, although available for utilization when required. The disclosure herein is of several ways of achieving the general objects of the invention, which are to provide a suitable encapsulated source of a radioactive material and to handle the source easily and safely at all times; that is, to make the source effective for use when required yet to keep it segregated and safe whether or not in use.

Another object of the invention is to provide a way of ensuring a prompt indication or alarm in the event any of the safeguard mechanism for the radioactive source at any time fails.

A further object of the invention is to provide a radiation source shielding and collimating arrangement which operates easily on agricultural machinery without any substantial likelihood of failure or malfunction yet which can properly be utilized in daily operation in rather unsophisticated surroundings and by relatively unskilled laborers.

Figure 1:
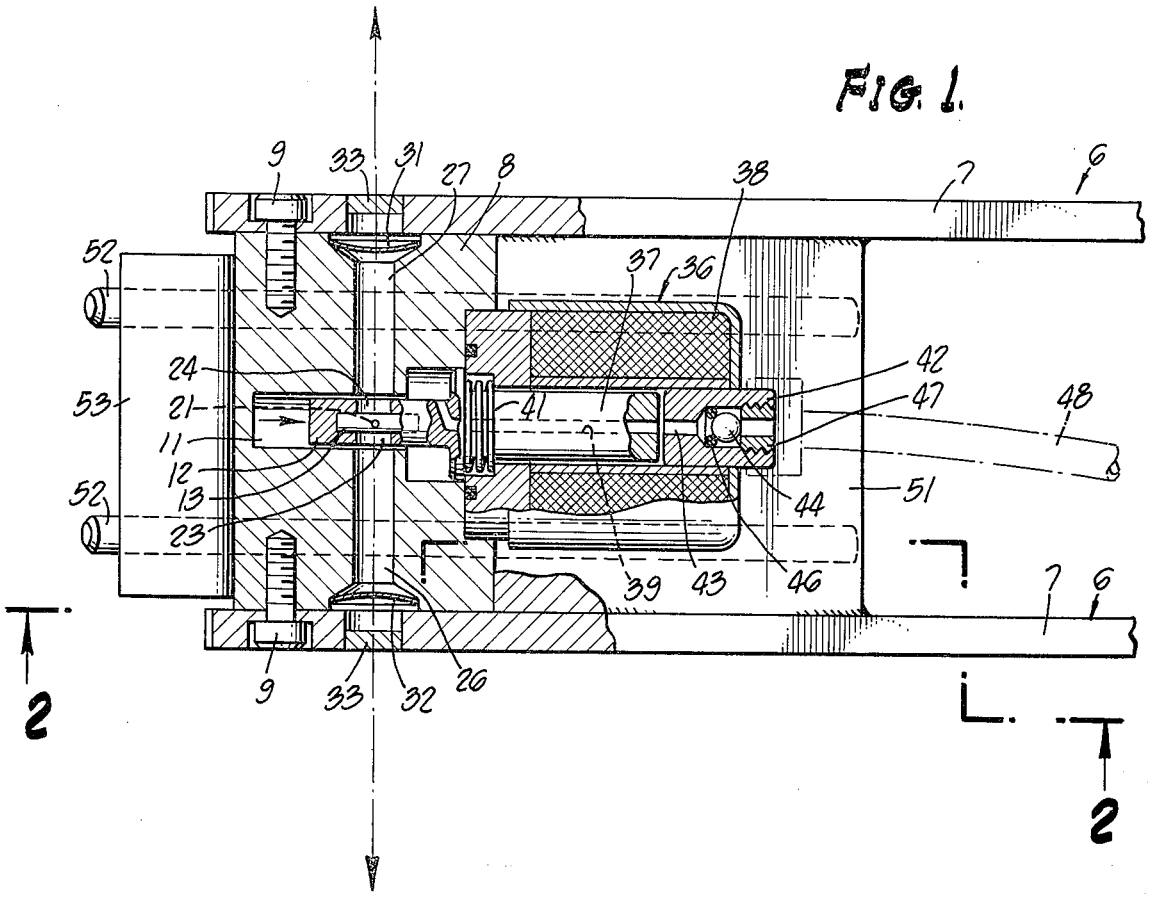
FIG. 1 is a plan of a portion of an agricultural machine carrying the radiation source shielding and collimating device constructed pursuant to the invention, portions of the figure being broken away to disclose the interior construction substantially on a median horizontal plane and indicating the parts in active relationship.
Figure 2:
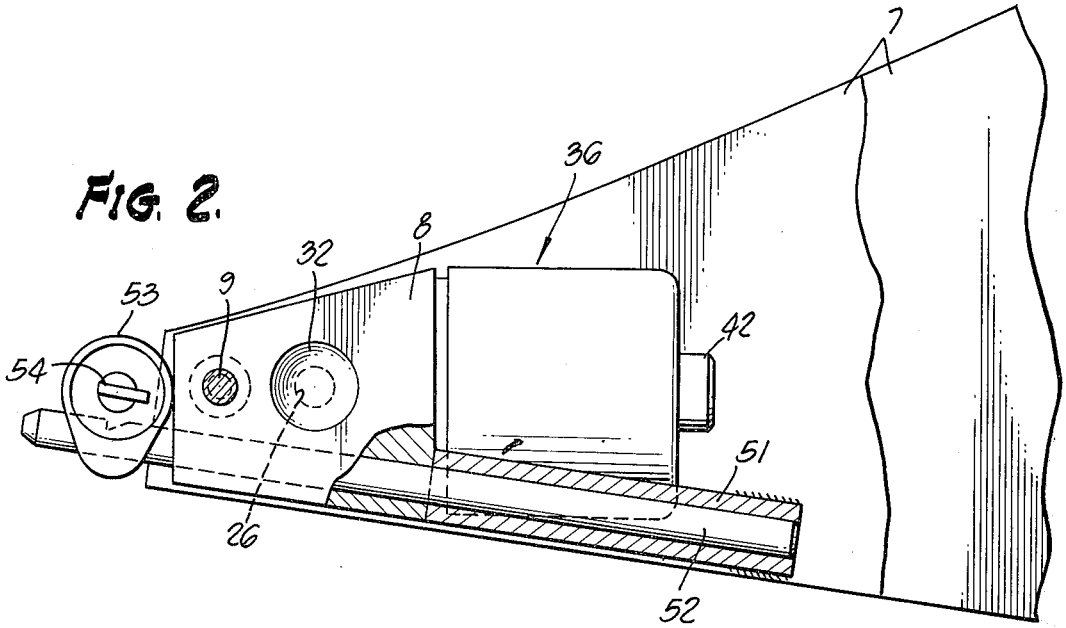
FIG. 2 is a cross-section, the planes of which are indicated by the line 2—2 of FIG. 1.

In one form of the device, the arrangement is adapted to be utilized on a frame 6 of an agricultural harvester, the frame including a pair of parallel plates 7 designed to operate at a short distance above the ground and to advance in a direction from right to left as seen in FIGS. 1 and 2.

Disposed between the plates is a block 8 removably held in position by cap screws 9 at either side thereof. The block is in the form of a solid metal body provided with a generally closed chamber 11 therein. The chamber is partially occupied by an metallic plunger 12 reciprocable within the chamber by an appropriate mechanism. The plunger is configured to contain a capsule 13 carrying radioactive material.

Figure 4:
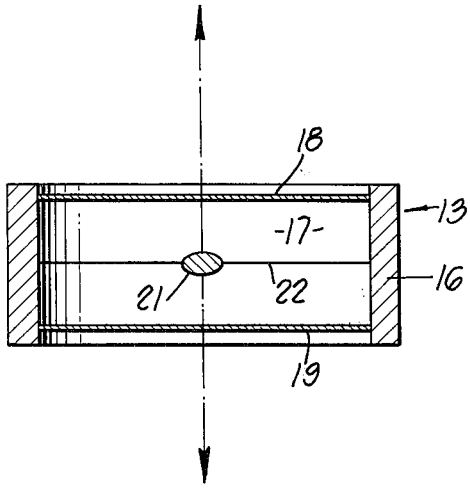
FIG. 4 is a schematic view in cross-section on a radiation capsule.
Figure 5:
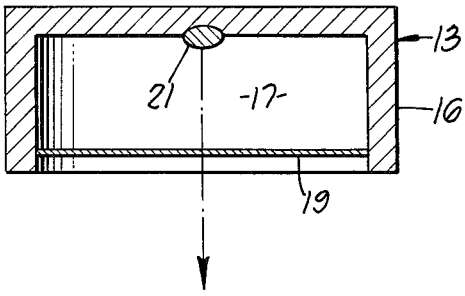
FIG. 5 is a schematic view in cross-section of another form of radiation capsule.

As shown in FIGS. 4 and 5, the capsule may take any of several forms. In one form, as shown in FIG. 4, a capsule wall 16 bounds part of a chamber 17 also bounded by membranes 18 and 19 permeable to radiation from the source material but impermeable to the atmosphere. Within the chamber 17 there is disposed a body 21 of Americium 241 or a comparable radioactive material disposed on a support 22. The membranes 18 and 19 and the surrounding walls 16 are entirely closed and carry the Americium substantially at atmospheric pressure, there being no air leakage into or out of the capsule. The capsule 13 when mounted in the plunger as shown in FIG. 1 occupies much of the interior space of the plunger. Radioactivity from the body 21 can travel outwardly through openings 23 and 24 or thin metal windows in the plunger but is otherwise confined.

The plunger is movable between a first position as shown in FIG. 1 in which the radioactive material and the windows 23 and 24 are in alignment with passages 26 and 27 in the impermeable block or body 8. These passages in turn communicate, so far as radiation is concerned, through radiation permeable flexible discs 31 and 32 with the exterior, there being windows 33 in the form of permeable plugs inset into the frame 6 for that purpose. The windows 33 are of thin aluminum or stainless steel or are also optically transparent, having sufficient density and being mounted to preclude air flow therethrough while allowing passage of radiation and a view of the discs 31 and 32.

Figure 3:
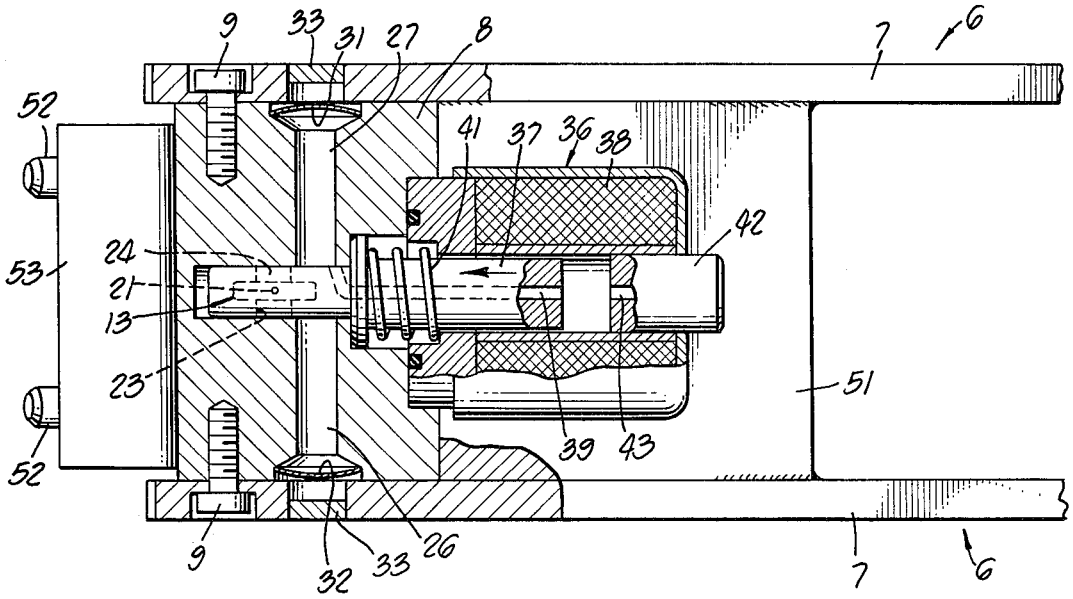
FIG. 3 is a view comparable to FIG. 1 but showing the parts in an inactive position.

The plunger 12 can move between the first position just described into a second position to the left thereof in FIG. 1 and as shown in FIG. 3. In the second position, the radiation source is out of alignment with the passages 26 and 27 and cannot, therefore, radiate to the outside. To move the plunger between those positions, there is provided an electromagnet 36 or solenoid having an armature 37 connected to and movable with the plunger under the influence of a magnetic coil 38, the arrangement being such that the chamber 17 and the interior mechanism of the solenoid are continuous or are in free communication through a central passage 39 as well as by outside clearance space.

When the coil 38 is energized, the plunger and armature are in the position shown in FIG. 1 despite urgency in the opposite direction by a helical spring 41. When the coil 38 is deenergized, then the force of the spring 41 is effective to translate the movable parts into the second position as shown in FIG. 3 with the radioactive material out of alignment with the passages 26 and 27 and so incapable of dissipating any radiation to the outside.

This mechanism is entirely effective to move the radiation source back and forth as desired, but it is desired to have even further protection against radiation. For that reason, the solenoid mechanism includes an end plug 42 with a central bore 43 therein, the bore being enlarged and containing a movable ball check valve 44 adapted in one position to seat on an 0-ring 46 in the plug. An apertured cap 47 retains the ball generally within its enclosure.

When the device has been set up, a flexible vacuum hose 48 is initially positioned against the end of the plug 42. This is effective to withdraw much of the atmosphere from the interior of the structure and to leave the chamber 11 and all of the connected spaces, including the interior of the solenoid mechanism, at a subatmospheric pressure. The low interior pressure causes the discs 31 and 32 to flex inwardly. After the interior pressure has been dropped to a low value, the temporary vacuum hose 48 is then removed. The ball 44 is then automatically pressed onto the 0-ring 46 and acts as a complete air seal. Under these conditions the interior of the capsule 13 is under atmospheric pressure, but the rest of the protective mechanism is operated under a vacuum.

As long as the vacuum is maintained, it can be assumed that the interior construction remains tight and that there are no gaps or leaks through which radiation can get away. Should the capsule integrity fail, however, or should there be an air leak from any point of the capsule, the vacuum or substmospheric pressure around the capsule is no longer maintained, and there is no longer a pressure difference between the chamber and outside to maintain the ball 44 on its seat. The discs 31 and 32 then flex outwardly, and the ball 44 by gravity can fall away from the seat. That situation can readily be detected by ordinary observation. The position of the discs and of the ball 44, therefore, acts as a monitor for the vacuum condition within the unit to indicate safety or the lack of safety.

It may be desired to take out the radiation unit and to replace it. But the unit cannot be left readily available to unauthorized persons. It is consequently preferred to include in or to span the frame 6 with a cross plate 51 drilled to receive the cut off but fastened in shanks 52 of an ordinary padlock. These shanks project to receive the customary lock bar 53 controlled by a key (not shown) in a keyway 54. Since the rear of the solenoid mechanism is in effect nested or seated in the cross plate 51 and the block 8 is on the shanks 52, as shown in FIG. 2, the device cannot be removed until a key operates the lock bar 53, which is then removed from the projecting shanks 52. Thereafter, upon removal of the machine screws 9, the entire assembly can be slid toward the left in FIGS. 1 and 2 and removed.

Figures 6, 7:
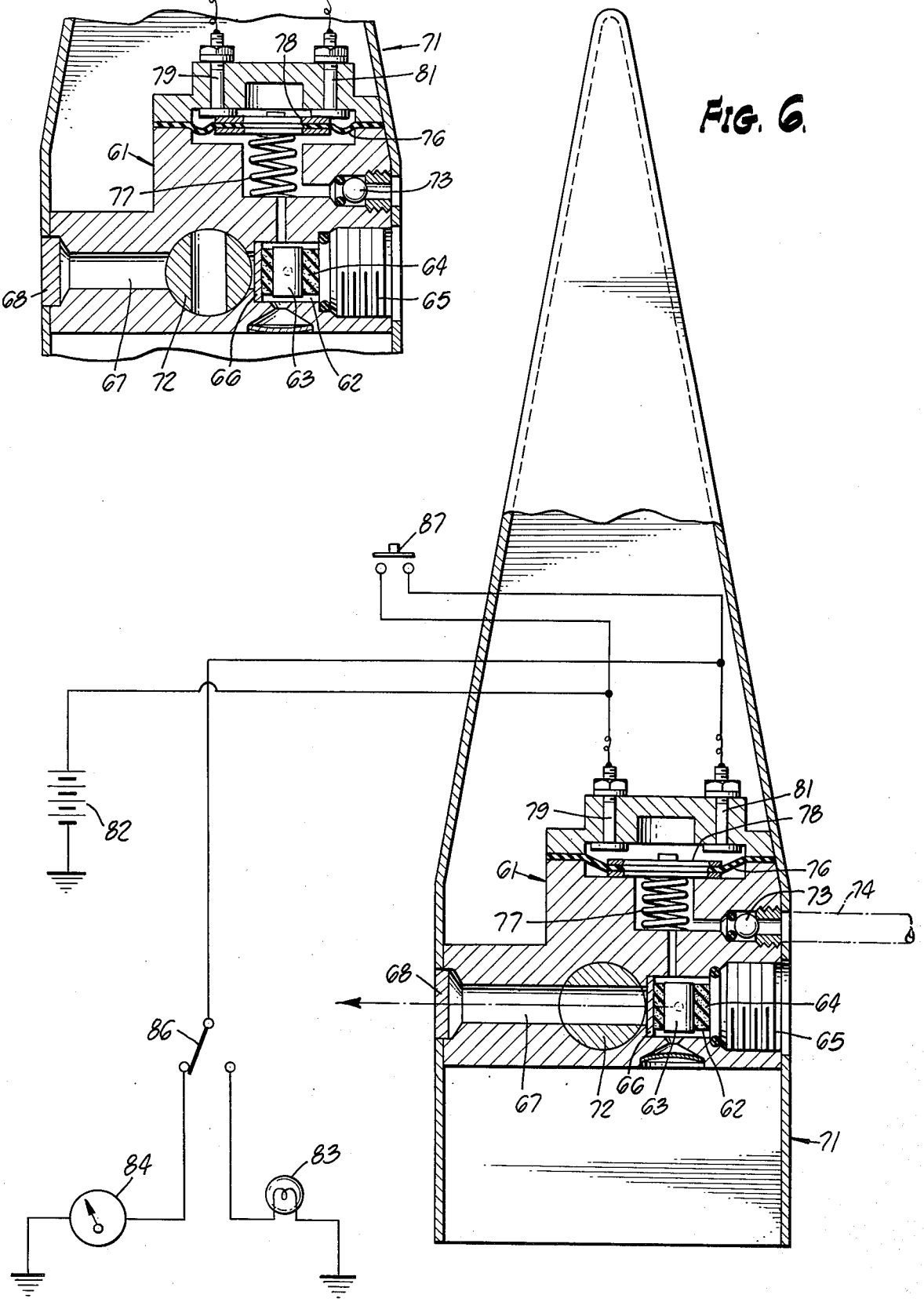
FIG. 6 is a view comparable to FIG. 1 but showing a modified form of structure and including diagrammatically some electrical circuitry.
FIG. 7 is a view of a portion of the structure as illustrated in FIG. 6 but with some of the parts in different positions.
Figure 8:
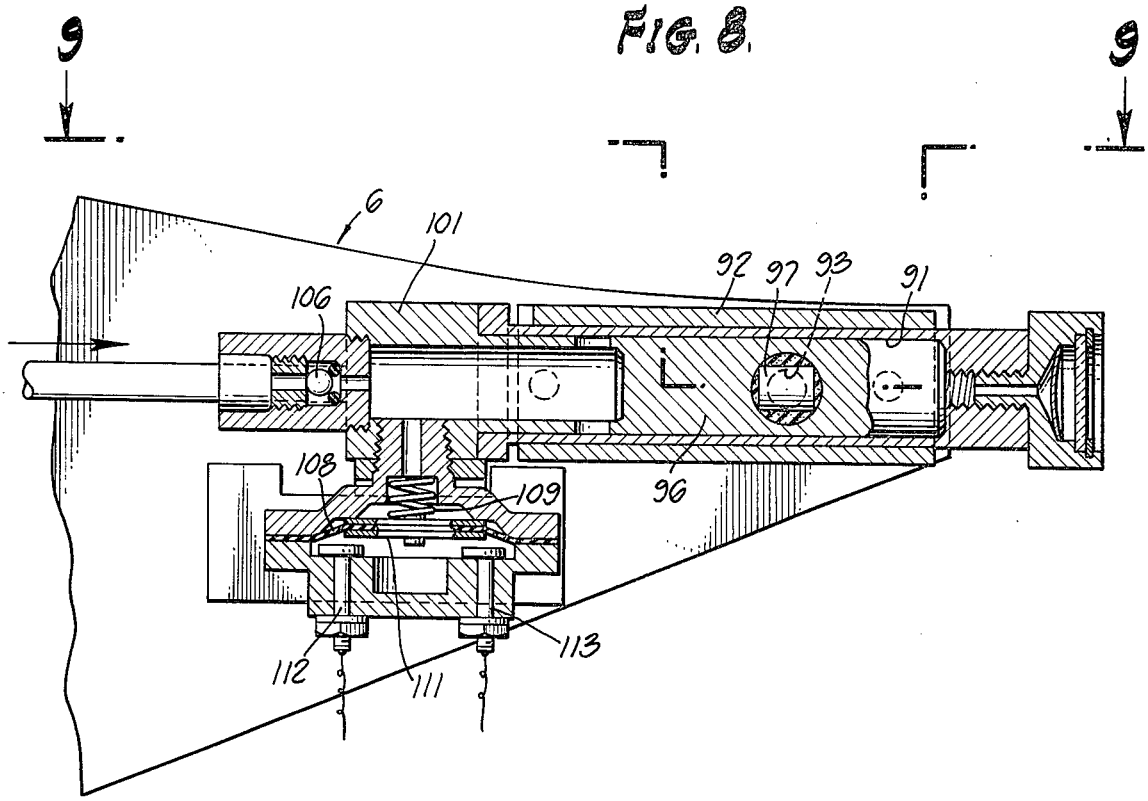
FIG. 8 is a view of a further modified form of device comparable to the arrangement in FIG. 1 and showing the parts in an active position.

There is a somewhat more extensive mechanism shown as an alternate, particularly in FIGS. 6 and 7, in which a more elaborate vacuum monitor is employed.

In this instance, a block 61 has a chamber 62 provided with a radioactive source 63 installed and cushioned by a polyurethane foam ring 64, the source being installed or removed through a sealed plug 65. The source operates in but one direction in this instance so that a form of source as shown in FIG. 5 can be employed. Passing radiation but making the chamber 62 air tight is a thin metal diaphragm 66. The source normally is in free communication with the exterior through the diaphragm and a passage 67 spanned by a flexible, thin metal window 68 lodged in the frame 71. A rotary valve 72 is provided in the block. When manually or by power turned into the location shown in FIG. 6, there is free egress for the radiation, but when the plug is turned manually or by power into the position shown in FIG. 7, such egress is blocked. The interior chamber 62 is subjected to vacuum through a valve 73 of the sort previously described and to which a vacuum hose 74 can be applied initially.

In this instance, in order to monitor the vacuum or pressure condition within the chamber 62, there is provided a responsive diaphragm 76 normally pulled into the position shown in FIG. 6 by the subatmospheric pressure acting thereon but also urged in the opposite direction by a coil spring 77. When the vacuum fails, the spring is effective to move a metallic contact washer 78 on the diaphragm to bridge stationary contacts 79 and 81. This then completes a circuit from a power source 82 either to an indicator light 83 or to an indicator gauge or sound alarm 84, depending upon the position of a control switch 86. In order to make sure that this circuitry is effective, there is also preferably provided a test switch 87 which when momentarily closed operates the alarm or the light to show circuit continuity.

The operation of this structure is substantially as previously described. There is always a monitor of the pressure condition within the chamber, so that if the pressure rises due to capsule failure or due to leakage of any sort, there is immediately afforded an appropriate alarm. In this instance also, while the radioactive capsule is not itself moved and while the valve 72 serves to release or isolate the radiation, the functions are substantially equivalent because there is relative motion between the capsule and the valve mechanism.

In another form of device as shown in FIGS. 8–11, there is provided a tubular chamber 91. The chamber is in a block 92 secured to the machine frame 6 as before. There is a cross passage 93 in the block communicating with the outside, as to radiation, through a window 94 solid to the atmosphere but transparent to the radiation.

Figure 9:
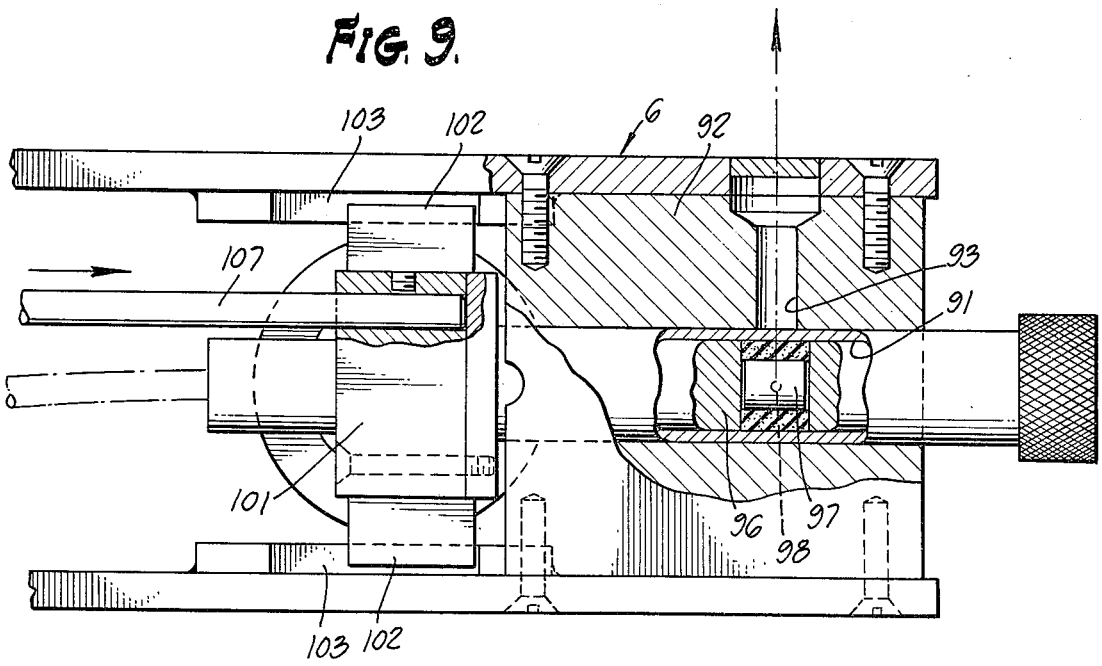
FIG. 9 is a view of the structure of FIG. 8, much of the figure being in cross-section as indicated by the line 9—9 of FIG. 8.
Figure 10:
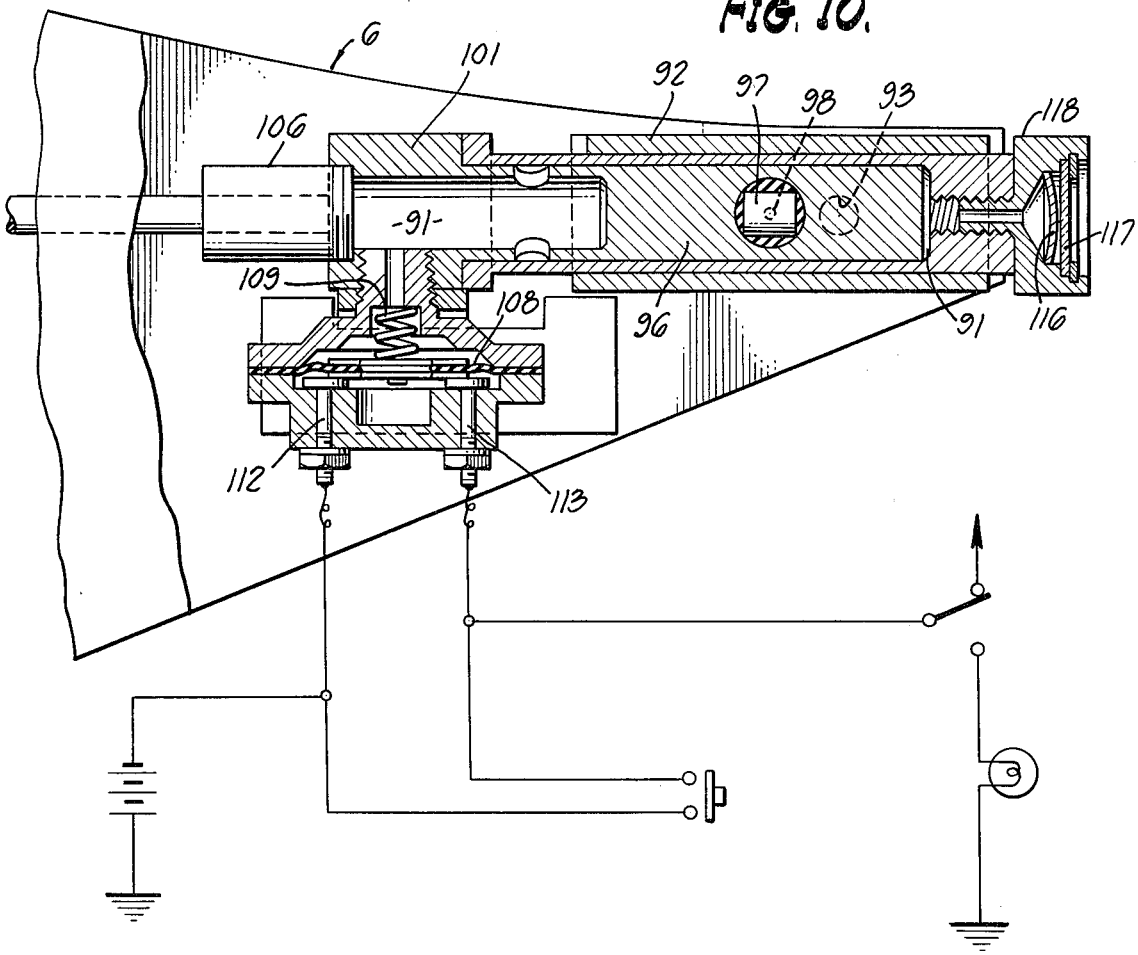
FIG. 10 is a view comparable to FIG. 8 but showing the parts in an inactive position and also diagrammatically including some associated electrical circuitry.
Figure 11:
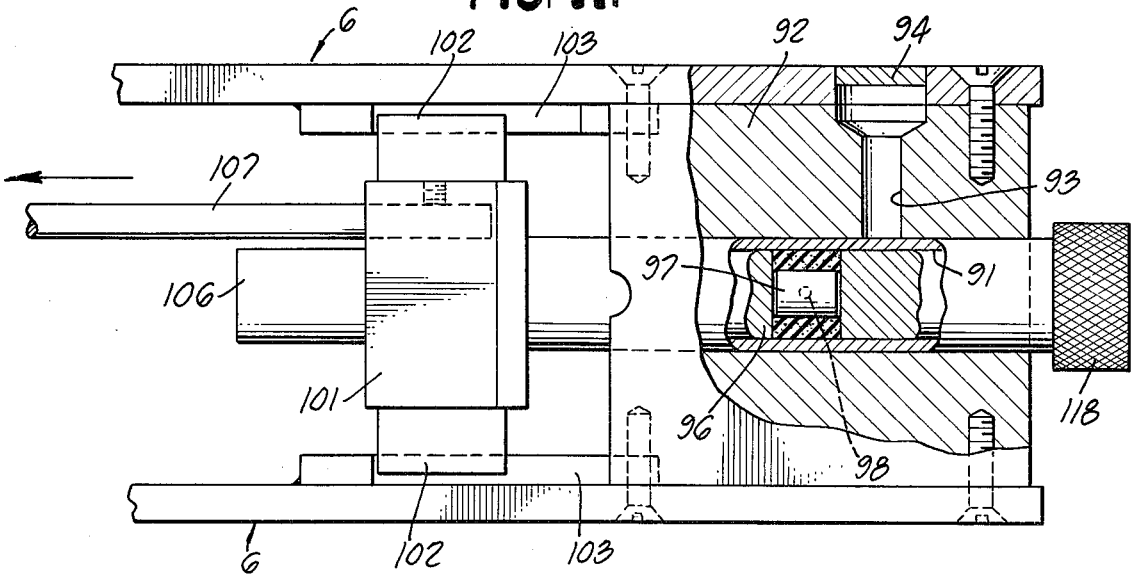
FIG. 11 is a view comparable to FIG. 9 but showing the parts in an inactive position.

Reciprocable within the chamber is a plunger 96 carrying a capsule 97 with a radioactive source 98 therein, the plunger being movable between a first position shown in FIG. 9 in which the source is in alignment with the passage 93 and a second position as shown in FIG. 11 in which the source is out of line with the passage. The plunger in this instance is moved by a slide 101 having side flanges 102 movable in tracks 103 on the frame, so that the slide is rectilinearly guided and held against rotation. The plunger also contains a vacuum closure valve 106 operable by a temporarily applied vacuum hose, as before. The slide carries an operating rod 107 movable to and fro to operate the plunger accordingly. The movement of the rod can be manual or can be by means of a solenoid, as shown in connection with FIG. 1.

In addition, the slide carries a vacuum responsive diaphragm 108 urged by a coil spring 109 to cause a metal washer 111 to bridge electrical contacts 112 and 113 substantially as before. Normally the diaphragm is prevented from so acting by the customary subatmospheric pressure within the chamber. In this instance also, during normal operation after the chamber and its associated spaces have been evacuated, the circuit is not energized, but should there be a disruption of the capsule, thereby increasing the interior pressure, or should there be a leak somewhere by which the interior pressure would be increased, then the circuit as previously described is energized, thus affording a prompt alarm. There is a visual indication also by a flexible disc 116 open to the chamber 91 and held behind a glass 117 in an end plug 118 fastened in the plunger.

I claim:

1. A radiation source shielding and collimating device comprising a body having a chamber therein, means defining a radiation passage from said chamber to the exterior of said body, a source of radiation at atmospheric pressure and in said chamber, means for subjecting said chamber to a subatmospheric pressure, and an indicator responsive to the pressure in said chamber.

2. A device as in claim 1 in which said source includes a sealed capsule at substantially atmospheric interior pressure, and radioactive material in said capsule.

3. A device as in claim 2 including a plunger movable in said chamber and carrying said capsule, and means for moving said plunger between a first position with said capsule in alignment with said passage and a second position with said capsule out of alignment with said passage.

4. A device as in claim 1 in which said passage is closed to air flow by a window readily permeable to radiation.

5. A device as in claim 1 including a spring for urging said plunger toward said second position.

6. A device as in claim 1 in which said subjecting means includes a check valve urged closed by subatmospheric pressure in said chamber and openable by exterior application of a vacuum hose thereto.

7. A device as in claim 1 in which said means for moving said plunger includes a solenoid.

* * * * *